US008432090B2

(12) United States Patent
Colard

(10) Patent No.: US 8,432,090 B2
(45) Date of Patent: Apr. 30, 2013

(54) STRIPPING MEMBER, A STRIPPING ASSEMBLY AND A METHOD FOR EXTRACTING A PARTICLE BEAM FROM A CYCLOTRON

(75) Inventor: Vincent Colard, Jauche (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 36 days.

(21) Appl. No.: 12/742,899

(22) PCT Filed: May 29, 2009

(86) PCT No.: PCT/EP2009/056670

§ 371 (c)(1),
(2), (4) Date: May 13, 2010

(87) PCT Pub. No.: WO2009/144316

PCT Pub. Date: Dec. 3, 2009

(65) Prior Publication Data

US 2011/0089335 A1 Apr. 21, 2011

(30) Foreign Application Priority Data

May 30, 2008 (EP) ..... 08157373

(51) Int. Cl.
*H05H 13/00* (2006.01)

(52) U.S. Cl.
USPC ..... 313/62; 315/502

(58) Field of Classification Search ..... 315/502; 313/62, 359.1
See application file for complete search history.

(56) References Cited

U.S. PATENT DOCUMENTS

| | | | | |
|---|---|---|---|---|
| 3,641,446 | A * | 2/1972 | Gordon | 315/502 |
| 3,866,132 | A * | 2/1975 | Gorka, Jr. | 315/505 |
| 3,896,392 | A * | 7/1975 | Hudson et al. | 315/502 |
| 6,057,655 | A | 5/2000 | Jongen | |
| 6,462,348 | B1 * | 10/2002 | Gelbart | 250/505.1 |
| 7,223,463 | B2 * | 5/2007 | Arakida | 428/219 |

FOREIGN PATENT DOCUMENTS

WO 97/14279 A1 4/1997

OTHER PUBLICATIONS

M. Abs et al., "A New Design of Truly Selfshielding Baby-Cyclotrons for Positron Emitter Production." Proceedings of the 1989 IEEE Particle Accelerator Conference. Accelerator Science and Technology (Cat. No. 89CH2669-0) IEEE New York, NY, USA, 1989, vol. 1, pp. 675-677.

E. Conard et al., "Current Status and Future of Cyclotron Development at IBA" Proceedings of 2nd European Particle Accelerator Conference, Jun. 1990, pp. 419-421.

(Continued)

*Primary Examiner* — Thuy Vinh Tran
(74) *Attorney, Agent, or Firm* — Fitch, Even, Tabin & Flannery LLP

(57) ABSTRACT

The present invention relates to a stripping member for stripping electrons off a negatively charged particle beam at the periphery of a cyclotron for extracting a particle beam out of said cyclotron, said stripping member comprising a first stripper foil adapted for being located at the periphery of said cyclotron so that said particle beam passes through said first stripper foil, characterized in that it comprises a second stripper foil adapted for being located side-by-side with the first foil at the periphery of said cyclotron at a more peripheral radius than said first stripper foil so that said negatively charged particle beam passes through said second stripper foil when said first stripper foil is damaged.

15 Claims, 5 Drawing Sheets

OTHER PUBLICATIONS

K. Jimbo et al., "Volume Production of Negative Hydrogen and Deuterium Ions in a Reflex-Type Ion Source." Nuclear Instruments & Methods in Physics Research, Section A (Accelerators, Spectrometers, Detectors and Associated Equipment) Netherlands, vol. A248, No. 2-3, Aug. 1, 1986, pp. 282-286.

G. Ciavola et al., "Operational Experience With the 450 kV Injector for the Superconducting Cyclotron," Nuclear Instruments & Methods in Physics Research, Section A (Accelerators, Spectrometers, Detectors and Associated Equipment) Netherlands, vol. 382, No. 1-2, Nov. 11, 1996, pp. 192-196.

V.P. Dmitrievsky et al., "Experimental Study of Simultaneous Acceleration of Protons and H-Ions in the Cyclotron." Proceedings of the 1st European Particle Accelerator Conference, Jun. 1988, pp. 616-618.

International Application No. PCT/EP2009/056670, Notification of Transmittal of the International Search Report and the Written Opinion of the International Searching Authority, or the Declaration, date of mailing Sep. 3, 2009, 12 pages.

International Application No. PCT/EP2009/056673, Notification of Transmittal of the International Search Report and the Written Opinion of the International Searching Authority, or the Declaration, date of mailing Sep. 3, 2009, 12 pages (related application).

P. Heikkinen et al., "Cyclotron Development Program At Jyvaskyla." AIP Conference Proceedings AIP USA, No. 600, 2001, pp. 89-93.

L. Calabretta et al., "High Intensity Proton Beams From Cyclotrons for H2<+>." Proceedings of the 1999 Particle Accelerator Conference (Cat. No. 99CH36366), IEEE Piscataway, NJ, vol. 5, 1999, pp. 3288-3290.

H. Ryuto et al., "Charge Strippers for Acceleration of Uranium Beam At Riken Ri-Beam Factory." 18th International Conference on Cyclotrons and Their Applications, 2007, Giardini naxos, Italy, p. 314.

R. Richardson. "Meson Factories." IEEE Transactions on Nuclear Science USA, vol. NS-12, No. 3, Jun. 1965, pp. 1012-1026.

* cited by examiner

STRIPPING MEMBER, A STRIPPING ASSEMBLY AND A METHOD FOR EXTRACTING A PARTICLE BEAM FROM A CYCLOTRON

CROSS REFERENCE TO RELATED APPLICATIONS

This application is a national phase application of International Application No. PCT/EP2009/056670, filed May 29, 2009, designating the United States and claiming priority to European Patent Application No. 08157373.5, filed May 30, 2008, both of which are incorporated by reference herein in their entirety.

TECHNICAL FIELD

The present invention relates to the field of charged particle accelerators, such as a cyclotron. More particularly, the present invention relates to a stripping member, a stripping assembly as well as a method for extracting a particle beam from a cyclotron.

DESCRIPTION OF RELATED ART

Cyclotrons are largely used in many applications such as medical applications (e.g. production of radioisotopes or particle therapy), scientific research and industrial applications.

A cyclotron is a re-circulation particle accelerator that works under high vacuum and accelerates ions up to energies of a few MeV, and even more. Charged particles, which have been previously generated by an ion source, are accelerated in a spiral motion within the cyclotron and are, at the end of said spiral motion, extracted from the cyclotron by means of an extraction system.

Particles acceleration within a cyclotron is achieved by using on the one hand a magnetic field, generated by an electromagnet, which causes the particles, coming from the ion source, to follow a circular path in a plane perpendicular to said magnetic field, and on the other hand by means of an electric field generated by a RF system (comprising a high frequency power supply) capable of applying a high-frequency alternating voltage which increasingly accelerates particles.

As a result, particles follow a spiral path by gaining energy (increase of energy implies an increase of particles orbit radius) until the outer radius of the cyclotron where they can either be extracted out of the cyclotron, or, in specific applications, used inside the cyclotron itself, for example for producing isotopes. However, in most of applications it is required to extract the ion beam out of the cyclotron, and guide it to a target where it can be used. In this case an extraction system is typically installed near the internal outer radius of the cyclotron.

For extracting positively charged particles the common extraction method is achieved by means of an electrostatic deflector which produces a strong electric field capable of deflecting accelerated particles from its acceleration orbit into an extraction orbit. This electrostatic deflector typically consists of a very thin electrode called septum which is placed between the last internal orbit of the cyclotron and the extraction orbit through which particles will be extracted. However, this extraction method has two main drawbacks, as follows. The first drawback is that the extraction efficiency of such a method is quite limited, thereby limiting the maximum beam intensity that can be extracted due to thermal heating of the septum by the intercepted beam. The second drawback is that interception of particles by the septum contributes strongly to the radio-activation of the cyclotron.

Another extraction method is known from EP0853867 (by the Applicant), wherein the ion beam can be extracted from the cyclotron without the use of any extraction system. However, the main drawback of this technique consists in that said method is complex.

Another common extraction method is the stripping extraction method which uses a carbon stripping foil in order to extract a negative ion beam coming from a negative ion source which is converted into a positive ion beam by stripping one or more of the electrons of the negative ion. The extraction efficiency of such a method can be as high as 99% and is much simpler than the previous ones and depends on the material thickness. The bigger thickness of a stripping material the more the ion beam is enlarged. As a consequence, the dispersion of the beam exiting the cyclotron increases when the thickness of the stripping foil increases.

Typically, carbon stripping foils are mounted on stripping probes or forks and are inserted inside the vacuum chamber of the cyclotron by means of a stripper arm in the outer region of the cyclotron (this insertion is well known in the art). Stripping foils are usually made up of carbon and have a size of the order of 2×2 cm. The high intensity negative ion beam (such as $H^-$ or $D^-$) is accelerated inside the accelerator along a spiral path and then it is scattered by such a stripping foil. During the hit between said negative ion beam and the surface of said stripper foil, two electrons of the negative ion beam are stripped away by the stripping foil, due to the Coulomb force between the atomic nucleus of the substance of said stripping foil and the negative ion beam. As a result, desired charged particles are obtained, such as protons for example, while the two stripped electrons are used to measure the current of the negative ion beam by means of grounded acquisition electronics.

Since in a cyclotron this interaction takes place in the magnetic field which provides the rotational component of the accelerating orbit, the change of the specific charge of the ion results in the change of direction of the ion orbit after the stripper foil. This particular effect is typically used for extracting an ion beam from a cyclotron, as represented in FIG. 1, wherein the negative ion $H^-$ orbit, before the stripper foil 100 comprising two stripper foils 10 and 20 (as more fully described herein), is represented by a solid line, while the positive ion $H^+$ orbit, after the stripper foil 100, is represented by a dashed line and where B represents the magnetic field direction perpendicular to the ion beam orbit. The two stripped electrons $2e^-$ are used for measuring the current of the ion beam by means of grounded acquisition electronics 101.

FIG. 2 similarly shows the extraction process of the negative ion beam 1000 in the extraction region of a cyclotron wherein a stripper foil 100 comprising two stripper foils 10 and 20 (as more fully described herein) is provided. The negative ion beam after passing through the stripper foil 100 changes its orbit radius and consequently exits the cyclotron.

In many applications, the energy of the ion beam generated by a cyclotron may not be fixed. In fact, the production of several ion beams with different energy (i.e. with different radius orbits) is typically required and, in this case, each of the desired ion beams has a corresponding foil position within the extraction region in order to extract the ion beam out of the cyclotron.

However, conventional stripping foils are very fragile due to extraction efficiency requirements and, consequently, are not capable of maintaining their physical properties during repeated ion hits. Such repeated hits typically cause in fact excessive heating and, consequently, damages of stripper foils. Moreover, when the vacuum condition of the accelerator is lost (during standard maintenance procedures or during the event of a sudden accidental vacuum loss, for example) the stripper foil typically cracks due to pressure variations. As a consequence, the lifetime of conventional stripper foils is very short, and typical lifetime ranges are from a few hours to a few days, depending on the beam current intensity and density.

As already mentioned, the choice of stripper foil thickness and, consequently, the stripper foil lifetime depend on the energy of the ion beam and also on the type of ion beam to be extracted. It is well known in the art that stripping foils having thickness between 2 μm and 5 μm have very high extraction efficiency but a very low durability (due to mechanical stress and/or heating due to repeated ion hits). By contrast, stripping foils with thickness between 16 μm and 50 μm have a very high durability but at the same time lower extraction efficiency which may be between for example between 50% and 65%.

The extraction efficiency depends therefore on the thickness of the stripping foil as follows. When the negative ion beam passes through the stripper foil, there are beam losses due to mechanism of multiple scattering. Multiple scattering consists in the increase of the beam emittance, i.e. the dispersal of the particle beam into a range of directions, when the beam passes through the stripper foil as a result of collisions between the particle beam and the stripper foil. The higher the thickness of the stripper foil, the more multiple scattering increases. Since the exit of the cyclotron has a very small diameter, if the emittance of the stripped particle beam is higher, a larger fraction of the particle beam may be lost because unable to pass through the exit of the cyclotron.

As mentioned before, conventional stripping foils are fragile and due to wear need to be replaced regularly. Replacing a stripper foil is cumbersome and takes time: the vacuum inside the cyclotron is broken, the cyclotron is opened, human doses in maintenance must be taken, the stripper foil is replaced, the cyclotron is closed, and the cyclotron is pumped down until good vacuum is obtained. To overcome this problem, Heikkinen et al. (Cyclotron development program at Jyvaskyla, Cylotron and their applications 2001, Sixteenth International Conference) have installed a stripper mechanism with a rotating foil holder having four stripper foils, in a vacuum tank of a 30 MeV cyclotron. In case a stripper foil is damaged, the stripper mechanism is rotated in order to position a new stripper foil in front of the beam. However, this mechanism is too cumbersome for smaller cyclotrons like 18 MeV cyclotrons. Moreover, in case of failure of a stripping foil, if the beam is not stopped, it hits and damages the vacuum chamber or other structures inside of the cyclotron. To avoid this, a probe is located inside the cyclotron to detect a failure and provide the information to stop the beam. Then the wheel is rotated to position a new stripping foil in the trajectory of the beam and the beam acceleration is restarted. In addition, the implementing of a probe for detecting a failure complicates the device and causes an additional bulk inside the cyclotron. Such a probe in combination with such a rotating foil holder is not implementable in the reduced volume available inside a smaller cyclotron. Another drawback of this solution brought by these authors is that even if the cyclotron is not opened, in the case of production of short half-life radioisotopes, it is important to minimize the time of replacing of the stripper foil and to avoid the stopping of the beam.

It is an object of the present invention to provide a new kind of stripping assembly and stripping member, as well as a method which overcome the drawbacks of the prior art.

It is another object of the present invention to provide a stripping assembly and a stripping member, as well as a method which provide high extraction efficiency and high durability with respect to conventional stripper foils during repeated ion hits and even when vacuum condition of the cyclotron is lost.

It is still another object of the present invention to provide a stripping assembly and a stripping member, as well as a method which on the one hand improves the throughput of the cyclotron and on the other hand minimizes maintenance procedures time.

SUMMARY OF THE INVENTION

The invention is related to a stripping member and methods as described in the appended claims. Specific embodiments are described in combinations of the independent claims with one or more of the dependent claims. According to a first aspect of the present invention, a stripping member for stripping electrons off a negatively charged particle beam at the periphery of a cyclotron, and for extracting a particle beam out of said cyclotron is provided. Said stripping member comprises a first stripper foil adapted for being located at the periphery of said cyclotron so that said particle beam passes through said first stripper foil and it further comprises a second stripper foil adapted for being located at the periphery of said cyclotron at a more peripheral radius than said first stripper foil and arranged in a common plane and in a side-by-side relationship with the first stripper foil, so that when said first stripper foil is damaged, said negatively charged particle beam passes through said second stripper foil. The stripper foils are arranged in such a way that the changeover from the first to the second foil in case of damage to the first foil takes place without the need to stop the beam and without the need to move the stripping member.

Advantageously, the thickness of said second stripper foil is higher than the thickness of said first stripper foil.

Preferably, said first stripper foil and said second stripper foil are both made of pyrolytic carbon.

More advantageously, said first stripper foil has a grammage comprised between 2 $\mu g/cm^2$ and 10 $\mu g/cm^2$ and said second stripper foil has a grammage comprised between 12 $\mu g/cm^2$ and 35 $\mu g/cm^2$.

According to a second aspect of the present invention, a stripping assembly for stripping electrons off a negatively charged particle beam at the periphery of a cyclotron for extracting a particle beam out of said cyclotron is provided. Said stripping assembly comprises the stripping member according to the first aspect of the invention as well as support means adapted to maintain said stripping member at the periphery of said cyclotron.

Advantageously, the stripping assembly further comprises adjusting means capable of adjusting the position of said stripping member within the cyclotron whereby increasing the extraction efficiency of said stripping member when said negatively charged particle beam is being stripped by said second stripper foil.

Preferably, according to said second aspect, said support means is adapted to support a second stripping member of the same type having a third stripper foil and a fourth stripper foil.

More preferably, said stripping assembly further comprises driving means adapted to move said support means from a first position wherein said negatively charged particle beam is stripped either by first stripper foil or second first foil of stripping member, to a subsequent second position wherein said negatively charged particle beam is stripped either by said third stripper foil or said fourth stripper foil of said second stripper member. According to an embodiment, said support means is a rotatable stripper head, rotatable around a vertical axis, perpendicular to the particle beam path.

According to a third aspect of the present invention, a method for stripping electrons off a negatively charged particle beam at the periphery of a cyclotron for extracting a particle beam out of said cyclotron is provided. This method comprises the following steps:

- providing the stripping member according to the first aspect of the invention;
- extracting said particle beam by means of the first stripping foil;
- without stopping said charged particle accelerator, in case said first stripping foil is damaged, extracting said particle beam by means of said second stripping foil.

Preferably, said step of extracting said charged particle beam by means of the second stripping foil further comprises the step of:

- adjusting by means of adjusting means the positioning of said stripping member inside said charged particle accelerator so as to increase the extraction efficiency of said second stripper foil.

More preferably, said method comprises the steps of:

- providing a second stripping member of the same type having a third stripper foil and a fourth stripper foil;
- providing support means for supporting said second stripping member and said stripping member;
- checking if said first stripper foil or said second stripper foil of said stripping member is damaged;
- when said check reveals damages, moving said support means in such a way that said charged particle beam is stripped either by said third stripper foil or said fourth stripper foil of said second support means.

DETAILED DESCRIPTION OF THE INVENTION

Figure 1:
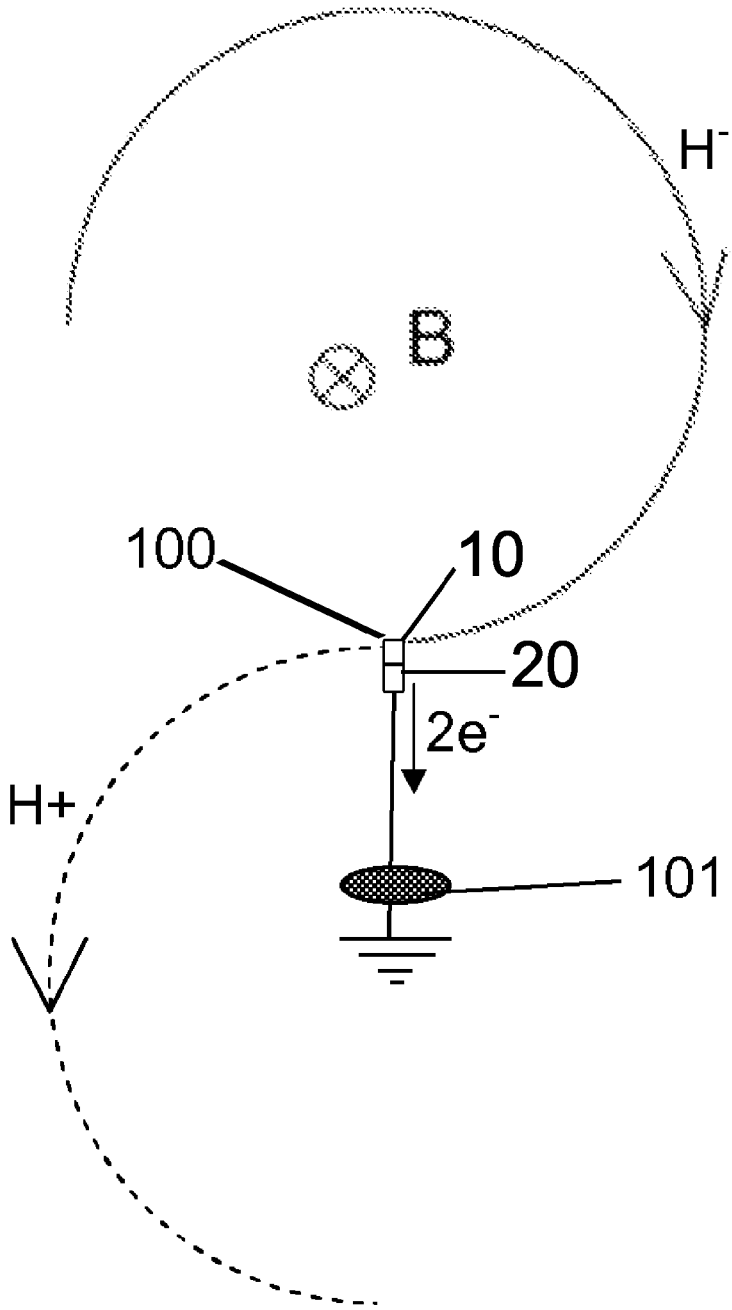
FIG. 1 show the interaction between a negative ion and a stripper foil. After this interaction, the negative ion becomes positive and consequently the orbit is modified.
Figure 2:
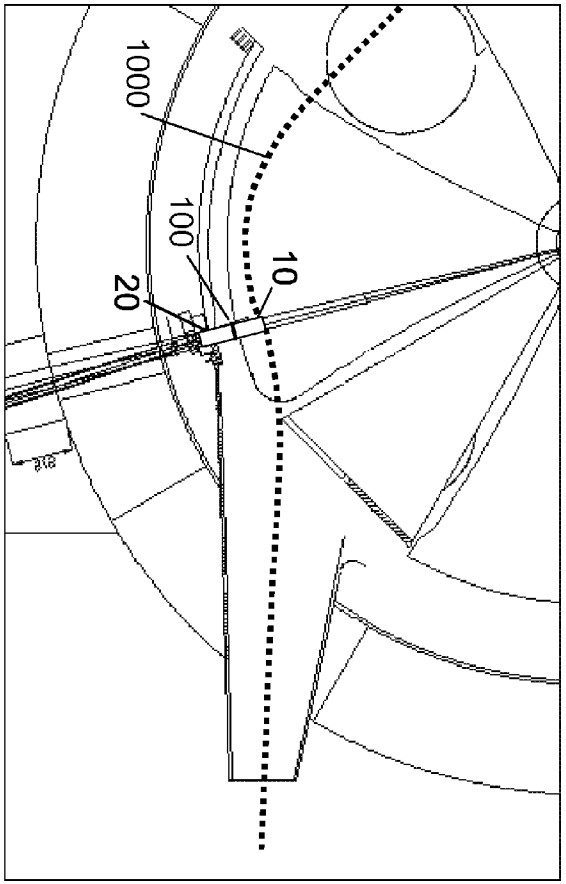
FIG. 2 shows a top view of a section of the extraction region of a cyclotron.
Figure 3:
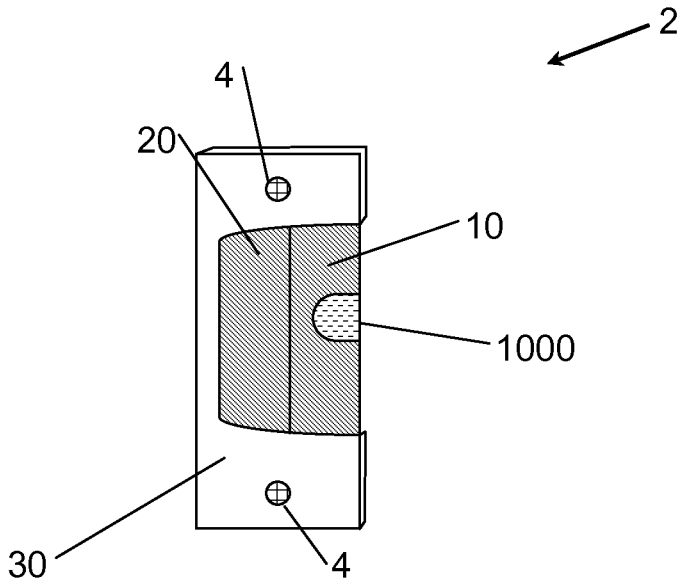
FIG. 3 and FIG. 4 show views of the stripping member of FIG. 3 when stripping the negative ion beam, according to a first aspect of the present invention.

According to a first aspect of the present invention, as schematically represented in FIG. 3, a stripper member 2 is provided. Said stripper member 2 comprises a first stripper foil 10 and a second stripper foil 20 which are sandwiched on both sides by means of a metallic fork 30 comprising two metallic frames tightened together by screws 4. Said metallic fork 30 maintains said first stripper foil 10 and said second stripper foil 20 arranged in parallel in a common plane and in a side-by-side relationship. This includes adjacent foils with edges in contact with each other, foils with overlapping edges and foils with an open space in between. No solid material such as metal is present however between the adjacent foils.

Said first stripper foil 10 is located at the distal region of the stripper member 2 while the second stripper foil 20 is located at the proximal region of the stripper member 2, in such a manner that when the stripper member 2 is inserted inside the cyclotron, first stripper foil 10 and second stripper foil 20 are respectively located in a more inwards position and in a more outwards position within the internal region of the cyclotron (the terms distal/proximal and inwards/outwards being with respect to the cyclotron's central axis). As a consequence, the negative ion beam 1000, during its spiral path, will reach at first the first stripper foil 10, as described below.

In other embodiments of the present invention, the two stripper foils 10, 20 may be supported by different forks and located at different radii in the cyclotron, whilst still being positioned side-by-side in a common plane. For example, two forks as shown in FIG. 3 may be positioned with the fork openings facing each other, each fork containing one foil.

Stripping foils 10, 20 are both made up of a pyrolytic carbon material which is a carbon material similar to graphite which is typically obtained by depositing gaseous hydrocarbon compounds on suitable underlying substrates (carbon materials, metals, ceramics) at temperatures ranging from 1000 to 2500 K (chemical vapour deposition). Pyrolytic carbon has a better durability and resistance with respect to conventional carbon used for manufacturing stripper foils.

According to an embodiment of the present invention, stripper foils 10, 20 have different thickness. A foil may be characterized by its thickness, expressed in μm or characterized by its grammage, like in paper industry, that is the mass per area of foil expressed here in $\mu g/cm^2$. The thickness of the foil in μm is obtained by dividing the grammage by the density of the foil material. For example, first stripper foil 10 has a thickness of 5 μm and presents, as noticed by the Applicant, an extraction efficiency of about 90%, while second stripper foil 20 has a thickness of 25 μm and presents an extraction efficiency of about 75%. As a consequence, second stripper foil 20 is more resistant to damages with respect to first stripper foil 10 but has lower extraction efficiency.

Figure 4:
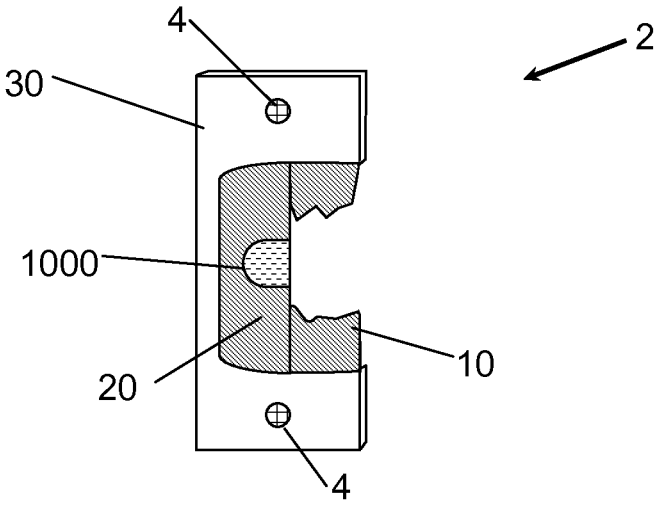

According to the invention, the second stripper foil 20 is used only when the first stripper foil 10 is damaged and acts, therefore, as a backup stripper foil. When in use, the stripper member 2 is positioned in a nominal position which is slightly inwards the outer internal region of the cyclotron (not shown), as well known in the art. After the high intensity negative ion beam 1000 has traveled its spiral path by gaining energy, it intercepts the first stripping foil 10 of the stripper member 2 and it is finally extracted by said first stripper foil 10. When said first stripper foil 10 should be damaged (caused for example by repeated hits, standard machine openings, or vacuum loss or heating, as previously described) as shown in FIG. 4, it is still possible to strip the negative ion beam 1000 by means of the second stripper foil 20. In fact, when first stripper foil 10 breaks, the negative ion beam 1000 is no more extracted and keeps turning inside the cyclotron until it reaches (after a certain number of further turns) the second stripper foil 20 of the stripping member 1, the latter which acts as a backup stripper foil. The change from the first foil to the second takes place automatically, i.e. without any outside interception, without the need to stop the beam and without movement of the stripping member with respect to the beam. In this manner, therefore, it is no more necessary to stop and open the cyclotron for replacing the damaged stripper foil with a new one. As a consequence the throughput of the cyclotron can be highly improved with respect to prior art. The use of a thin first stripper foil 10 allows the cyclotron to have very high extraction efficiency, but the foil is also more fragile and will break more easily. It is advantageous in that case to have a second stripper foil which is thicker.

Figure 5:
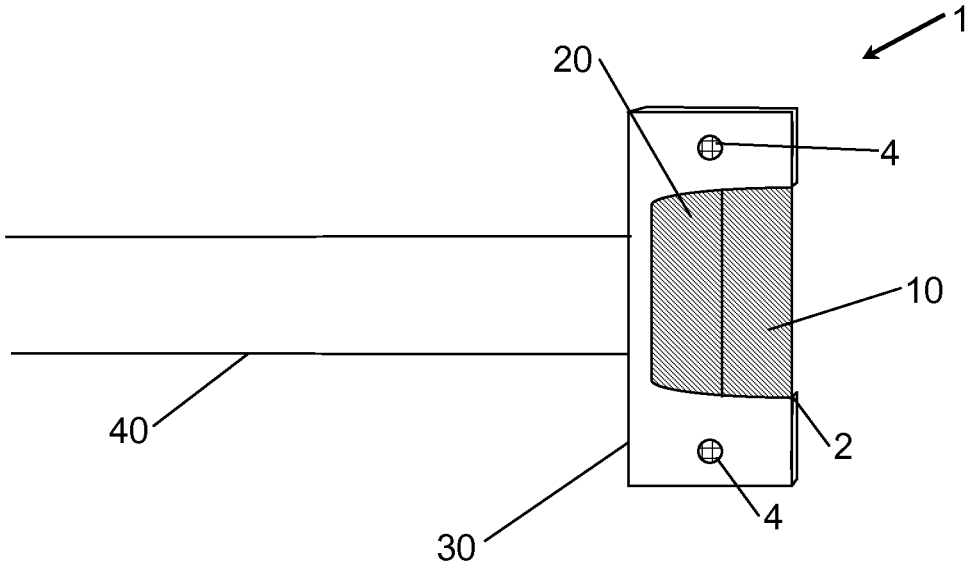
FIG. 5 is a view of a stripping assembly according to a first embodiment of a second aspect of the present invention.

According to a second aspect of the present invention, a stripper assembly 1, as schematically shown in FIG. 5, is provided. The stripper assembly 1, according to a first embodiment, comprises a support means, such as a stripper arm 40, for maintaining said stripping member 2, within the cyclotron, in the outer internal region thereof.

Adjusting means (not shown) for adjusting the position of the stripping assembly 1 and therefore the position of said second stripper foil 20 with respect to the incoming negative ion beam 1000 within the cyclotron may be further provided in order to decrease the dispersion of the stripped particle beam over the exit of the cyclotron and therefore increase the extraction efficiency of the second stripper foil 20. The adjusted position may be any position, linear or angular, e.g. linear along a radial direction with respect to the central axis, or angular around said central axis or around a horizontal axis.

Figure 6:
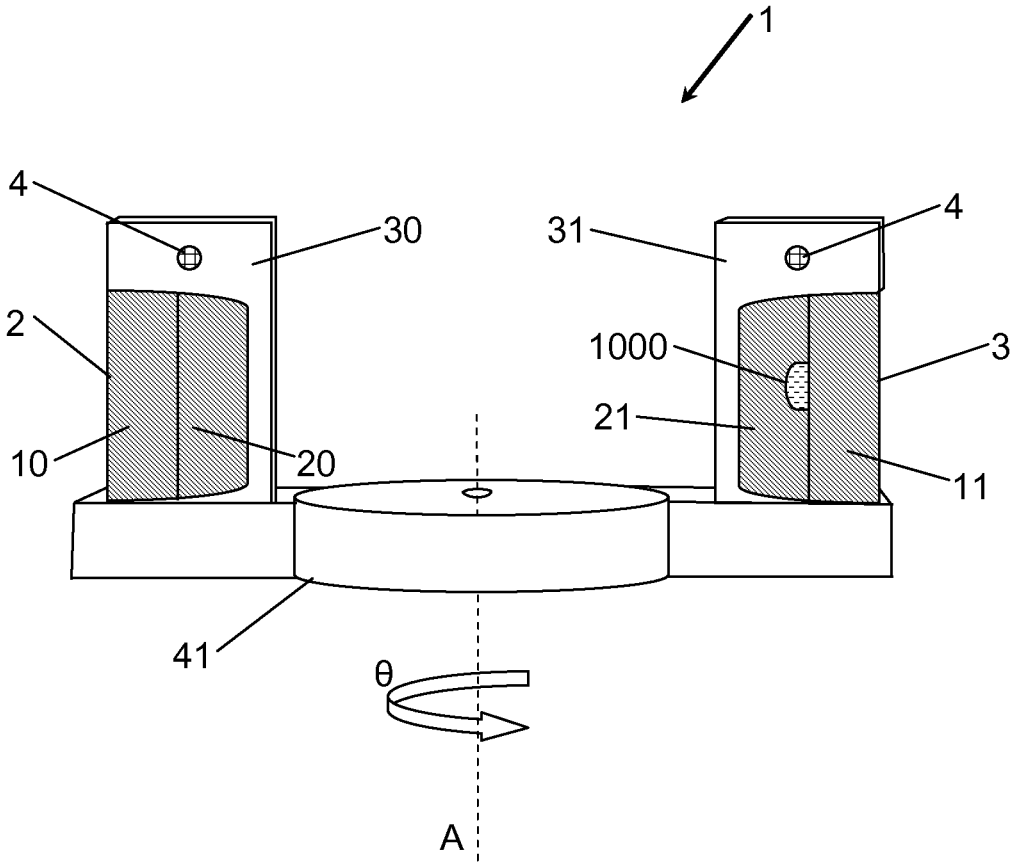
FIG. 6 is a perspective side view of a stripping assembly according to a second embodiment of the second aspect of the present invention.

According to a second embodiment of the second aspect of the present invention, said stripping assembly 1 comprises, instead of the stripping arm 40, a stripper head 41 capable of supporting an additional second stripping member 3, the latter comprising a third stripper foil 11 and a fourth stripper foil 21, maintained by means of a second fork 31, as represented by FIG. 6. Said stripper head 41 is capable of rotating by means of driving means (not shown) around a vertical axis A perpendicular to the negative ion beam 1000.

Third stripper foil 11 and fourth stripper foil 21 of second stripping member 3 have the same characteristics as first stripper foil 10 and second stripper foil 20 of stripping member 2 respectively. According to this second embodiment, it is possible to rotate the stripping assembly 1 so as to intercept the negative ion beam 1000 either with stripping foils 10, of stripping member 2 or with stripping foils 11, 21 of second stripping member 3. As shown in FIG. 6 the negative ion beam 1000 is being stripped by the stripper foil 21 of second stripping member 3, after rotating the stripping head 41 over a predefined angle 8 around the axis A.

According to a third aspect of the present invention, a method for stripping said negative ion beam 1000 coming from a charged particle accelerator is provided. By following the steps of such a method it is possible to easily and quickly replace a damaged stripper foil with a second one without stopping and opening the cyclotron. In fact, when the first stripper foil 10 has been damaged, as already described, the negative ion beam 1000 is no more extracted and keeps turning until it reaches the second stripper foil 20 of said stripper member 2. The second stripper foil 20 consequently acts as a backup foil.

According to a variant of said third aspect of the present invention, it is also possible to rotate the stripping assembly 1 of FIG. 6 over a certain predefined angle θ in such a way that the negative ion beam 1000 is consequently stripped by one of the stripper foils 11, 21 of the second stripping member 3, while the stripping member 2 with damaged stripper foils 10, 20 can be easily put aside from the trajectory of the negative ion beam 1000. However, it is clear that depending on the application one can decide which stripper foil of which stripping member is to be used. Therefore, the order in which one uses the stripper foils can be easily modified without departing from the invention. Using the embodiment of FIG. 6, it is possible to rotate the holder over θ while the beam remains active, so that foils 11 and 21 act as back-up foils. However, the preferred way of operating is by choosing the thicknesses of the foils 10 and 20 in relation to a particular treatment, so that it is substantially certain that the back-up foil 20 does not break during beam-operation. After the treatment, it is then possible to rotate the holder so that an additional treatment can be given, using foils 11 and 21. In this way, the vacuum remains unbroken between foil replacements.

One or more embodiments of the present invention have been described in detail with reference to the attached figures. It is evident that the invention is only limited by the claims, since the figures described are only schematic and therefore non-limiting. In the figures, the size of some of the elements may be exaggerated and not drawn on scale for illustrative purposes. The dimensions and the relative dimensions do not necessarily correspond to actual reductions to practice of the invention. Further, those skilled in the art can recognize numerous variations and modifications of this invention that are encompassed by its scope. Accordingly, the description of preferred embodiments should not be deemed to limit the scope of the present invention.

The invention claimed is:

1. A stripping member configured to strip electrons off a negatively charged particle beam at a periphery of a cyclotron for extracting a particle beam out of said cyclotron, said stripping member comprising a first stripper foil configured to be located at the periphery of said cyclotron so that said negatively charged particle beam passes through said first stripper foil, the stripping member further comprising a second stripper foil configured to be located at the periphery of said cyclotron at a more peripheral radius than said first stripper foil and arranged in a common plane and in a side-by-side relationship with the first stripper foil, so that when the first stripper foil is damaged, said negatively charged particle beam passes through said second stripper foil.

2. The stripping member according to claim 1 wherein the thickness of said second stripper foil is higher than the thickness of said first stripper foil.

3. The stripping member according to claim 1 wherein said first stripper foil and said second stripper foil are both made of pyrolytic carbon.

4. The stripping member according to claim 1 wherein said first stripper foil has a grammage comprised between 2 $\mu g/cm^2$ and 10 $\mu g/cm^2$ and said second stripper foil has a grammage comprised between 12 $\mu g/cm^2$ and 35 $\mu g/cm^2$.

5. An assembly configured to strip electrons off a negatively charged particle beam at the periphery of a cyclotron, for extracting a particle beam out of said cyclotron, the assembly comprising:

the stripping member according to claim 1; and a support configured to maintain said stripping member at the periphery of said cyclotron.

6. The assembly according to claim 5, further comprising an adjustment device configured to adjust the position of said stripping member within the cyclotron, thereby increasing the extraction efficiency of said stripping member when said negatively charged particle beam is being stripped by said second stripper foil.

7. The assembly according to claim 5, further comprising an additional stripping member comprising a third stripper foil and a fourth stripper foil, wherein the support is configured to support the additional stripping member.

8. The assembly according to claim 7, further comprising a driving device configured to move said support from a first position wherein said negatively charged particle beam is stripped either by the first stripper foil or the second stripper foil, to a second position wherein said negatively charged particle beam is stripped either by said third stripper foil or said fourth stripper foil.

9. The assembly according to claim 7 wherein said support is a rotatable stripper head, rotatable around a vertical axis, perpendicular to a path of the particle beam.

10. A method for stripping electrons off a negatively charged particle beam at the periphery of a cyclotron for extracting a particle beam out of said cyclotron, the method comprising:

providing a stripping member comprising a first stripper foil and a second stripper foil configured to be located at the periphery of the cyclotron, the first stripper foil and the second stripper foil arranged so that when the first stripper foil is damaged, the negatively charged particle beam passes through the second stripper foil;

extracting said particle beam with the first stripper foil; and without stopping said cyclotron, in case said first stripper foil is damaged, extracting said particle beam with the second stripper foil.

11. The method according to claim 10 wherein said step of extracting said particle beam with the second stripper foil further comprises adjusting the positioning of said stripping member inside said cyclotron so as to increase the extraction efficiency of said second stripper foil.

12. The method according to claim 10 further comprising:

providing a support;

moving said support when said first stripper foil or said second stripper foil is damaged in such a way that said negatively charged particle beam is stripped either by a third stripper foil or a fourth stripper foil of an additional stripping member.

13. A stripping member configured to strip electrons off a negatively charged particle beam at a periphery of a cyclotron for extracting a particle beam out of the cyclotron, the stripping member comprising a first stripper foil configured to be located at the periphery of the cyclotron so that the negatively charged particle beam passes through the first stripper foil, the stripping member further comprising a second stripper foil configured to be located at the periphery of the cyclotron at a more peripheral radius than the first stripper foil, so that when the first stripper foil is damaged, the negatively charged particle beam passes through the second stripper foil.

14. An assembly comprising:

a stripping member comprising:

a first stripper foil configured to be located at a periphery of a cyclotron so that a negatively charged particle beam passes through the first stripper foil, and a second stripper foil configured to be located at the periphery of the cyclotron at a more peripheral radius than the first stripper foil, so that when the first stripper foil is damaged, the negatively charged particle beam passes through the second stripper foil; and a support configured to maintain the stripping member at the periphery of the cyclotron.

15. The assembly according to claim 14, further comprising an additional stripping member comprising a third stripper foil and a fourth stripper foil, wherein the support is configured to support the additional stripping member.

* * * * *